United States Patent [19]

Hildreth

[11] 4,327,754

[45] May 4, 1982

[54] PERMANENT WAVE ACCESSORY

[76] Inventor: Michael S. Hildreth, 9 Rose Ave., Savannah, Ga. 31406

[21] Appl. No.: 204,962

[22] Filed: Nov. 7, 1980

[51] Int. Cl.[3] ..... A45D 2/00

[52] U.S. Cl. ..... 132/40

[58] Field of Search ..... 132/40, 42, 142, 144, 132/126, 106, 7, 9

[56] References Cited

U.S. PATENT DOCUMENTS

| | | | |
|---|---|---|---|
| 1,849,543 | 3/1932 | Gadd | 131/126 X |
| 1,936,674 | 11/1933 | Keele | 132/7 |
| 2,281,853 | 5/1942 | Miller | 132/7 |
| 2,558,305 | 6/1951 | Marvin | 132/40 UX |
| 2,590,669 | 3/1952 | Zachary | 132/40 X |
| 2,682,878 | 7/1954 | Pisciotta | 132/40 |

*Primary Examiner*—G. E. McNeill

*Attorney, Agent, or Firm*—Beveridge, DeGrandi & Kline

[57] ABSTRACT

A permanent wave accessory including a base implement for pre-sectioning of hair, the base implement being conformable to the scalp contour and positionable in a spaced apart relation from the scalp; roller means for receiving hair as pre-sectioned by the base implement, such roller means being axially deformable in accordance with the scalp contour as assumed by the base implement; and means for mounting the roller means side-by-side along the base implement and which may cooperatively interact with the roller means for maintaining the roller means at a given position of rotation as interconnected therewith.

16 Claims, 13 Drawing Figures

FIG. 4
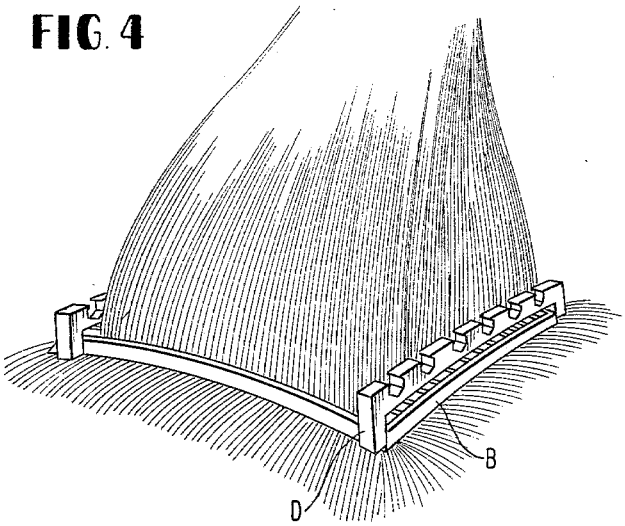
FIG. 5
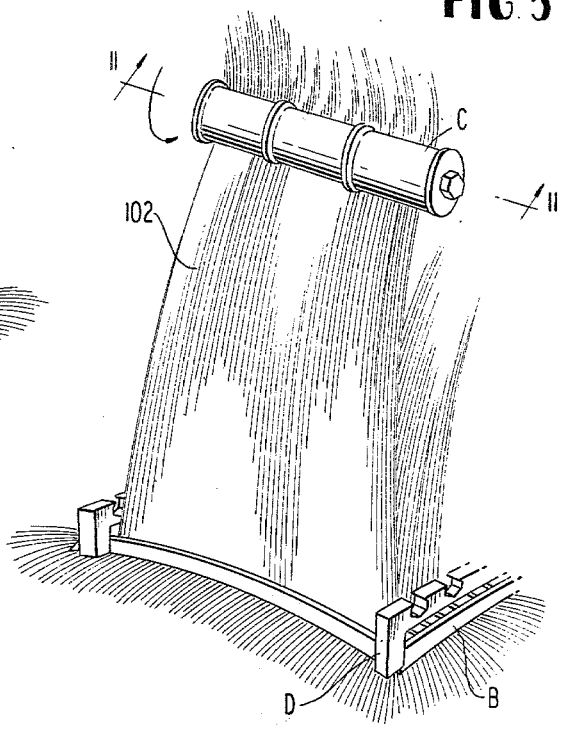
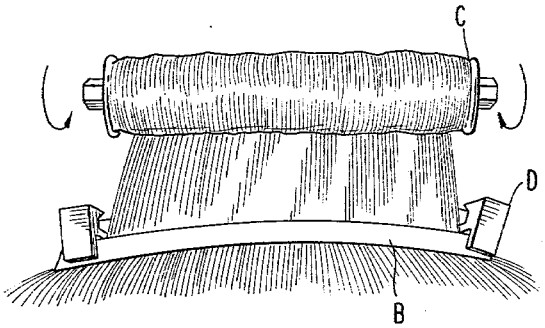
FIG. 6
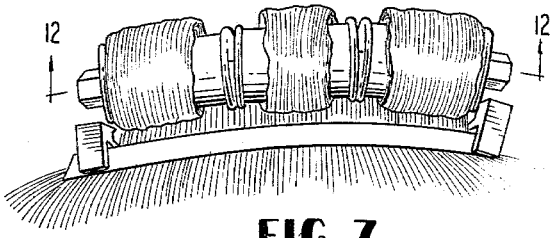
FIG. 7
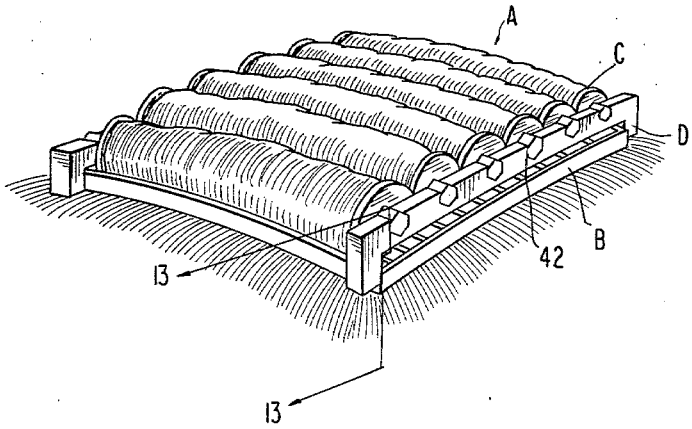
FIG. 8
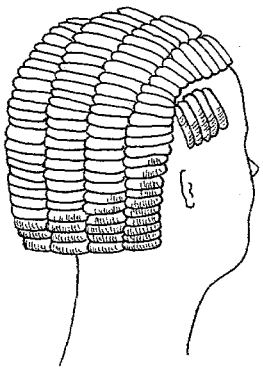
FIG. 9

PERMANENT WAVE ACCESSORY

BACKGROUND OF THE INVENTION

This invention relates to improvements in a permanent wave accessory for pre-sectioning and rolling hair in waving thereof.

Prior devices for rolling hair may be generally divided into two groups, namely, the well-known type designed for home treatments, which usually comprise a single roller rotatably mounted on a rectangular frame and including a band or strap for holding a lock of hair as wound on the roller; and those designed for professional use, which may include a plurality of rollers disposed in a manner to require complex manipulation thereof, and having various types of mechanical devices, bands, clamps, etc., for holding a lock of hair as wound thereon, for instance, as shown in U.S. Pats. Nos. 1,887,556; 1,936,674; 1,993,680; 2,281,853; and 2,480,588. It may be noted that even though devices previously intended for professional use include a plurality of rollers, the same are usually designed for rolling of only a single lock of hair thereon, albeit the same may be divided into a main strand and sub-strands, as in U.S. Pat. No. 2,281,853.

Thus, in use of these known hair rollers, a comb is used to segregate a lock of hair and the same is then wound on the roller or rollers thereof. Of course, as an increasing number of rollers are used, it becomes more and more difficult to properly position the same about the scalp area without interfering with each other and stacking of one upon another such as to incompletely treat the full length of a lock of hair, and it becomes almost impossible to manipulate those which require an articulation of parts near the scalp.

Also, these known hair rolling devices are of generally rigid construction and are accordingly incapable of being contoured to the scalp; do not apply uniform tension along a lock of hair; directly contact the scalp; and afford no assistance by way of pre-sectioning hair for permanent wave treatment. Accordingly, use of the same may result in and contribute to hair breakage and uneven curling.

BRIEF SUMMARY OF THE INVENTION

The primary object of this invention is the provision of a permanent wave accessory for pre-sectioning and rolling of hair in a manner such as to provide even curling and to minimize breaking or splitting of the hair as treated thereby.

A further object is the provision of a permanent wave accessory having a plurality of rollers for receiving a number of pre-sectioned locks of hair, thus decreasing the number of separate hair roller support frames required; and which does not require manipulation of parts thereof in a manner such that an adjacent accessory is likely to interfere with positioning thereof, thus facilitating placement of the same about the scalp.

Still further objects of the invention are the provision of a permanent wave accessory that may be used for pre-sectioning of hair, in which the operable parts thereof are spaced apart from the scalpline in a manner to minimize hair breakage, and which may be contoured to the scalp in a manner to provide even hair curling.

Other objects and advantages of the invention will become apparent from the following detailed description, taken in connection with the accompanying drawings.

BRIEF DESCRIPTION OF THE DRAWINGS

The invention will be better understood from a reading of the following detailed description and a study of the drawings, wherein:

FIG. 4 is a view showing the attachment of side frame means to the base implement of FIG. 3.

FIG. 5 is a view showing initiation of the rolling of a lock of pre-sectioned hair on a roller means.

FIGS. 6 and 7 are views similar to FIG. 5 showing progressive rolling of a hair segment on the roller means of FIG. 5.

FIG. 8 is a view showing fully wound roller means as attached to the side frame means.

FIG. 9 is a view showing use of a plurality of my permanent wave accessories for full treatment of the hair.

DETAILED DESCRIPTION OF THE DRAWINGS

Figure 1:
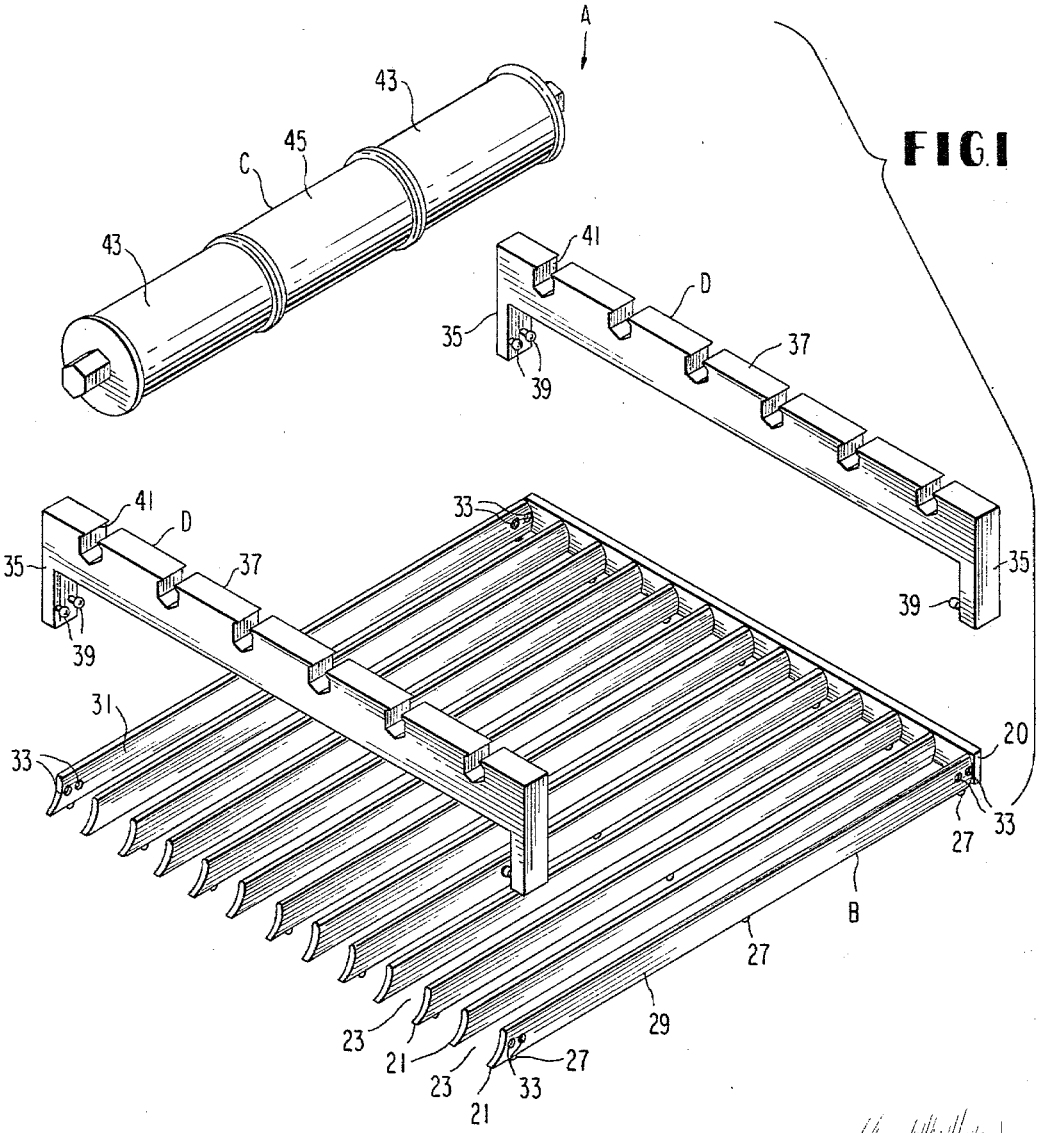
FIG. 1 is an exploded perspective view showing the base implement, side frame means and roller means of my invention.

In the drawings, wherein is shown a preferred embodiment of the invention and wherein similar reference characters designate corresponding parts throughout the several views, the letter A may generally designate my improved permanent wave accessory; B the base implement thereof; C the roller means thereof; and D the mounting means thereof for supporting roller means C on base implement B.

Base implement B preferably includes an elongated side member 20 having a plurality of elongated and substantially parallel teeth 21 interconnected at one end thereof to side member 20; teeth 21 defining therebetween a plurality of channels 23 opening at the end of teeth 21 opposite from the end of interconnection thereof to side member 20. Base implement B may thus comprise a comb-like device for insertion through the hair in pre-sectioning of hair within channels 23.

Figure 13:
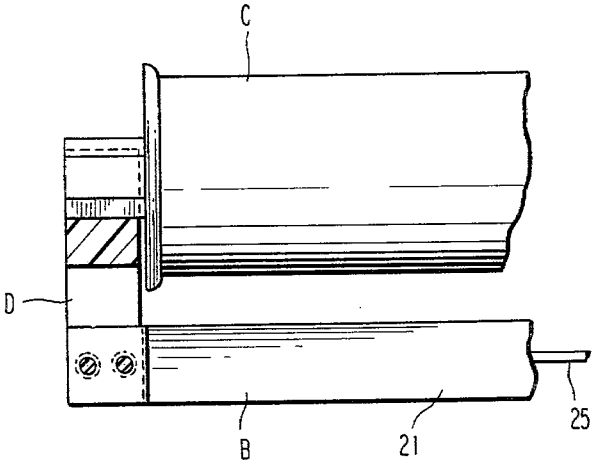
FIG. 13 is a fragmentary view, partly in section, taken substantially along the line 13—13 of FIG. 8.

As best shown in FIG. 13, base implement B may be formed of vinyl or any other suitable material which is sufficiently pliant as to be conformable to the contour of the scalp. Wire means 25 may be centrally disposed within each of teeth 21 and side member 20 to retain the shape of base implement B as conformed to the scalp contour.

As best shown in FIG. 4, alternate teeth 21 may be provided with leg means 27, generally taking the shape of nodules depending below teeth 21 and side member 20.

Each end of the outermost teeth, 29 and 31, may be provided with apertures 33 as an element of connector means 34 for attachment thereof of side frame means D.

Each side frame means D preferably includes an elongated bridge piece having an end post 35 at each end thereof. Each end post 35 may have peg means 39 on the side thereof facing the other post 35, as an element of connector means 34. Side frame means D is preferably formed of a vinyl and wire construction similar to that of base implement B.

Bridge piece 37 of side frame means D may be provided with a plurality of socket means 41 as an element of attaching means 42 for receiving roller means C. Socket means 41 may be of a hexagonal shape, for a purpose as will hereinafter be described.

Figure 11:
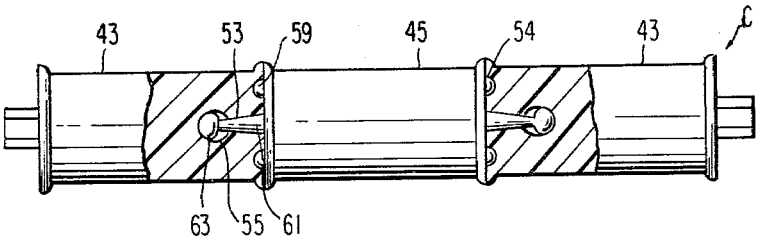
FIG. 11 is a partial sectional view taken substantially along the line 11—11 of FIG. 5.

Each roller means C may include a plurality of roller segments 43 and 45. The construction of roller segments 43 and 45 is most clearly shown in FIGS. 11 and 12. As shown, roller means C may include two end roller segments 43 and a central roller segment 45. As will be apparent, roller means C may be composed of any desired number of roller segments.

Figure 12:
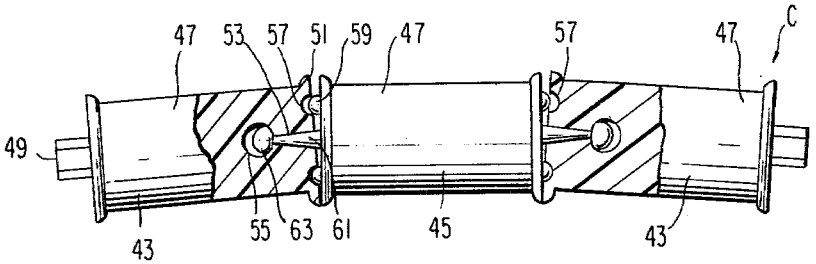
FIG. 12 is a partial sectional view taken substantially along the line 12—12 of FIG. 7.

Each of roller segments 43 is provided with a substantially cylindircal main body portion 47 and a shaft means 49. Shaft means 49 comprises an element of attaching means 42 for supporting roller means C on side frame means D. Thus, shaft means 49 is preferably peripherally shaped to mate with and interfit with socket means 41 of side frame means D. Each roller segment 43 may have an interior face 51 provided with a recess 53. Recess 53 decreases in width from face 51 for a distance and then increases to form an internal chamber 55. Interior face 51 may also be provided with dimples 57 which comprise an element of fastener means 54. Each face of roller segment 45 may be provided with lugs 59 for interfitting within dimples 57 of each roller segment 43, as an element of fastener means 54. Each face of roller means 45 is provided with axle means 61 having ball 63 on the end thereof. Axle means 61 is tapered to correspond to the shape of recess 53, ball 63 on the end of axle 61 being axially shorter than the axial length of chamber 55 by an amount at least equal to the axial length of lug 59. Thus roller segments 43 and 45 are movable toward and away from each other by an amount approximately equal to the length of lug 59, whereby in their separated position each roller segment may be independently rotated about an axle 61, and in the closed position such rotation is inhibited by the engagement of lugs 59 in dimples 57. Furthermore, by virtue of this construction, roller means C is axially deformable, as shown in FIG. 12.

Figure 2:
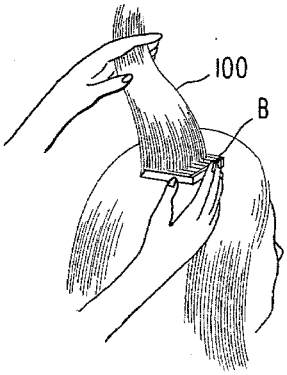
FIG. 2 is a view showing the base implement thereof being applied to the hair.
Figure 3:
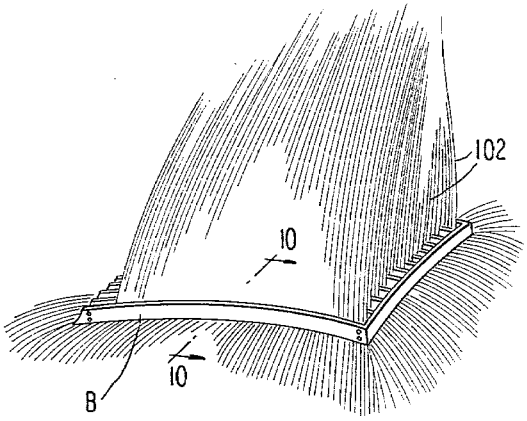
FIG. 3 is an enlarged showing of the base implement as applied in pre-sectioning of hair.
Figure 10:
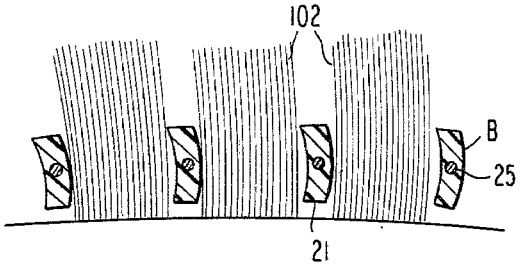
FIG. 10 is an enlarged transverse sectional view taken substantially along the line 10—10 of FIG. 3.

The rolling of the hair using the above-identified apparatus can be easily achieved by carrying out a few simple steps:

1. As shown in FIG. 2, base implement B is "combed" into a shank of hair 100, whereby teeth 21 pre- section shank 100 into a plurality of locks 102, as shown in FIGS. 3 and 10. Base implement B can then be pressed toward the scalp to take on a curved contour as shown in FIG. 3. It is to be noted that legs 27 on base implement B support the teeth 21 above the scalp, thereby reducing the tendency of the apparatus to break the hair. As shown in FIG. 2, the initial base implement B is placed centrally on the scalp and later base implements B are mounted proximate thereto extending outwardly to cover the entire distribution of hair on the head.

2. Once base implement B is in place, side frame means D are each mounted on base implement B by partially deforming it so that pegs 39 on side frame member D engage apertures 33 on base implement B, as shown in FIG. 4.

3. Then roller means C is engaged with the ends of a lock of hair 102 and the hair of such lock is wound thereon, as shown in FIG. 5, to a point as shown in FIG. 6, forming a spiral roll of hair on roller C. Up until this point, the various roller segments 43 and 45 are held in close relation to inhibit rotation of roller segments 43 with respect to roller segment 45. As roller means C approaches the assembled base implement B and side frame member D, the various roller segments are separated so that they may rotate with respect to one another and be axially deformed with respect to each other, as shown in FIG. 7. Thus, outer roller segments 43 can be rolled up as close to the scalp as central roller segment 45 and the entire roller means C can be made to take the general contour of base implement B. Shafts 49 can then be interfitted with socket means 41 to inhibit rotation of the roller means and secure them to the base implement B and side frame member D, as shown in FIG. 8.

4. The remainder of the hair on the head can likewise be set by continuing the above steps with additional permanent wave accessories A.

5. The permanent setting solution can then be applied to the wound spiral of hair according to the directions of the setting solution manufacturer.

Use of the above-described invention in the manner indicated provides equal tension throughout the curl of the hair so that a uniform curl results. Furthermore, breakage of hair is kept to a minimum. The rectangular shape of base implement B and the easy mode of use described facilitate the placement of the same about the scalp without interference between adjacent permanent wave accessories .

I claim:

1. A permanent wave accessory including a base implement, a pair of elongated side frame means, and a plurality of roller means, said base implement including an elongated side member having a plurality of elongated and substantially parallel teeth interconnected at one end thereof to said side member, said teeth defining therebetween a plurality of channels for pre-sectioning of hair, said channels opening at the end of said teeth opposite from the end of interconnection thereof to said side member for insertion through the hair in pre-sectioning of hair therebetween, said side frame means being mounted on said base implement in a substantially parallel spaced apart relation to each other as respectively extending transversely of said channels of said base implement and including attaching means for supporting said roller means thereon as individually extendant substantially along one of said channels of said base implement for receiving hair thereof as pre-sectioned through such one said channels.

2. A permanent wave accessory as specified in claim 1 and including connector means for removably mounting at least one said side frame means on said base implement adjacent the open end of said channels in providing a closure to retain hair therewithin as pre-sectioned thereby, the other of said side frame means being mounted on said base implement adjacent said side member thereof.

3. A permanent wave accessory including a base implement having a plurality of elongated teeth defining a plurality of elongated channels therebetween for pre-sectioning of hair, said base implement being sufficiently pliant for substantially contouring the same to the scalp, a plurality of elongated roller means, and mounting means for supporting said roller means on said base implement as individually extendant substantially along one said channels to receive hair thereon as pre-sectioned through one said channels of said base implement, said roller means being axially deformable for substantially conforming the same to the contouring of said base implement.

4. A permanent wave accessory as specified in claim 3 wherein said channels between said teeth of said base implement are open at at least one thereof for insertion through the hair in pre-sectioning thereof within said channels.

5. A permanent wave accessory as specified in claim 4 wherein said mounting means for supporting said roller means on said base member comprise elongated side frame means extending transversely of said teeth of said base implement adjacent the ends of said channels as defined therebetween and having attaching means for supporting said roller means thereon.

6. A permanent wave accessory as specified in either of claims 4 or 5 and including connector means for removably mounting at least one said side frame member on said base implement in providing a closure extendant across the open end of said channels to retain hair therewithin as pre-sectioned thereby.

7. A permanent wave accessory as specified in either of claims 1 or 5 and wherein said side frame means are interconnected to the endmost of said teeth at each end of said base implement, one said side frame means being interconnected thereto adjacent the extremities thereof at one side of said base implement and the other of said side frame means being interconnected thereto adjacent the extremities thereof at the other side of said base implement.

8. A permanent wave accessory as specified in either of claims 1, 2, 3, 4, or 5 and wherein said base implement includes leg means for abutment against the scalp in supporting said teeth thereof above the scalp surface.

9. A permanent wave accessory as specified in either of claims 1 or 5 wherein said attaching means of said side frame means comprise a plurality of socket means and said roller means include shaft means at each end thereof for interfitting within said socket means of said side frame means, said socket means and said shaft means being of an interconnectable configuration to inhibit rotation of said roller means when said shaft means is interfitted within said socket means of said side frame means.

10. A permanent wave accessory as specified in claim 1 wherein said side member and said teeth of said base implement are sufficiently pliant for substantially contouring said base implement to the scalp.

11. A permanent wave accessory as specified in either of claims 3, 4, 5, or 10 wherein said roller means include a plurality of roller segments, fastener means for supporting said segments to rotate as a unit, and axle means for independent rotation thereof on release of said fastener means.

12. A permanent wave accessory as specified in claim 11 wherein said attaching means for supporting said roller means includes a plurality of socket means and said roller means include shaft means at each end thereof for interfitting within said socket means, said socket means and said shaft means being of an interconnectable configuration to inhibit rotation of said roller means when said shaft means is interfitted within said socket means.

13. A method of rolling hair on a head comprising the steps of:

a. pre-sectioning a shank of hair into a plurality of locks by means of a comb-like implement and deforming said comb-like implement to the general contour of said head, b. connecting a side frame means to said comb-like implement to maintain said pre-sectioned locks in said comb-like implement, c. rolling at least one of said locks on roller means to form a spiral of hair of said lock, d. attaching said roller means to said side frame means to maintain said lock in the form of a spiral.

14. A method of rolling hair as claimed in claim 13 wherein said rolling step (c) comprises the steps of (i) rolling said lock on a substantially cylindrical roller means, maintaining said roller means in a substantially cylindrical shape, (ii) partially separating said roller means into independently rotatable roller segments and separating said lock into lock sections being rolled on individual ones of said independently rotatable roller segments and continuing to roll said lock sections on the respective roller segments, and (iii) axially deforming said roller means to conform to the general contour of said comb-like implement.

15. A method of rolling hair as claimed in either of claims 13 or 14, wherein said shank of hair is centrally located on said head and after the completion of step (d) with said centrally located shank, adjacent shanks are treated by steps a, b, c and d.

16. A method of rolling hair as claimed in claim 15 further comprising the step of:

e. applying a setting solution to said spiral of hair.

* * * * *